US007406976B1

(12) United States Patent
Chan et al.

(10) Patent No.: US 7,406,976 B1
(45) Date of Patent: Aug. 5, 2008

(54) WINCH-ACTUATED UMBRELLA

(75) Inventors: Ping Chiu Chan, Hong Kong (CN); Bao Tao Wu, Guangdong (CN); Xiang Li, Hong Kong (CN)

(73) Assignee: Chiaphua Components Limited, Hong Kong SAR (CN)

( * ) Notice: Subject to any disclaimer, the term of this patent is extended or adjusted under 35 U.S.C. 154(b) by 0 days.

(21) Appl. No.: 11/693,181

(22) Filed: Mar. 29, 2007

(51) Int. Cl.
*E45B 25/14* (2006.01)
*E45B 17/00* (2006.01)

(52) U.S. Cl. ..... 135/20.3; 135/16; 135/98; 135/20.1; 248/514

(58) Field of Classification Search ..... 135/15.1, 135/16, 74, 90, 98, 20.3, 20.1; 116/173; 211/197; 248/514; 403/91–92
See application file for complete search history.

(56) References Cited

U.S. PATENT DOCUMENTS 3,129,715 A * 4/1964 Militano et al. ..... 135/20.3
3,311,119 A * 3/1967 Pearlstine ..... 135/20.3
3,870,062 A * 3/1975 Medlin ..... 135/20.3
4,011,881 A * 3/1977 Becher ..... 135/20.3
4,424,824 A 1/1984 Becher
5,152,495 A * 10/1992 Jacinto et al. ..... 248/545
5,291,908 A * 3/1994 Grady, II ..... 135/22
5,386,842 A * 2/1995 Becher ..... 135/20.3
6,311,705 B1 * 11/2001 Ma ..... 135/20.3
6,364,562 B1 * 4/2002 Tung ..... 403/93
6,543,464 B1 4/2003 Grady, II
6,575,182 B2 * 6/2003 Tung ..... 135/20.1
6,622,741 B2 * 9/2003 Lai ..... 135/20.3
6,722,381 B2 * 4/2004 Lai ..... 135/20.3
6,761,180 B1 * 7/2004 Lai ..... 135/20.3
6,871,659 B2 * 3/2005 Tung ..... 135/20.3
6,953,043 B2 * 10/2005 Yu ..... 135/20.1
7,188,633 B2 * 3/2007 Zerillo ..... 135/20.3
2006/0151019 A1 * 7/2006 Lo ..... 135/20.3

FOREIGN PATENT DOCUMENTS

WO WO 2006032162 A1 * 3/2006

OTHER PUBLICATIONS

U.S. Appl. No. 11/493,543, filed Jul. 27, 2006, Ping Chiu Chan.

* cited by examiner

*Primary Examiner*—Winnie Yip
(74) *Attorney, Agent, or Firm*—Leydig, Voit & Mayer, Ltd.

(57) ABSTRACT

A winch for opening and closing an umbrella includes a winch drum mounted within an elongate support tube of the umbrella, to rotate about a longitudinal axis thereof. A threaded shaft is coaxial and rotationally fast with the drum. A line is fixed at one end to the drum and at other end to a sleeve, to which struts are pivotally connected, each strut being associated with a canopy-supporting rib. A travelling nut is engaged with the threaded shaft and blocked for rotation relative to the tube. A guide is fixed to the nut for guiding the line onto the drum, and a motor is also enclosed in the support tube and drivingly connected to the winch drum.

5 Claims, 5 Drawing Sheets

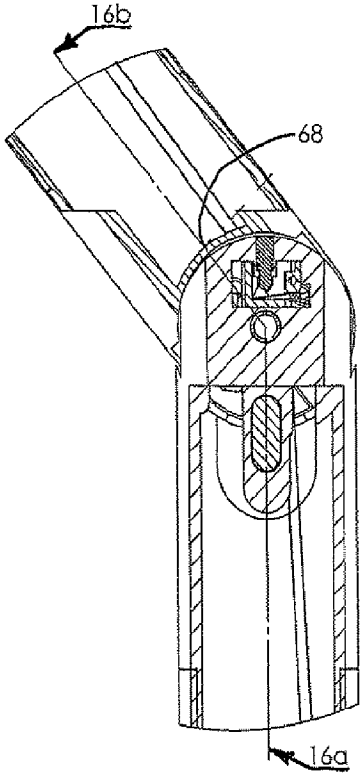
FIG.10
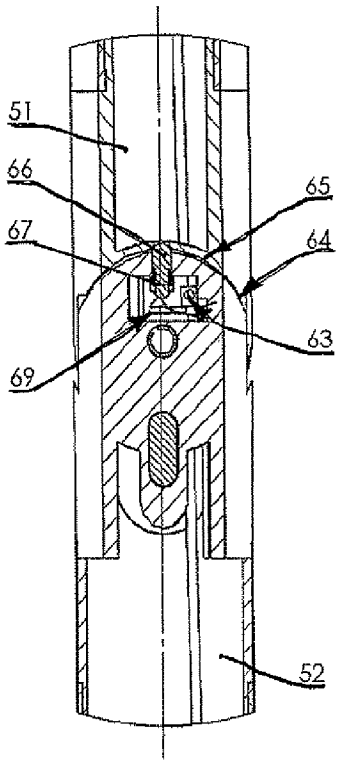
FIG.9
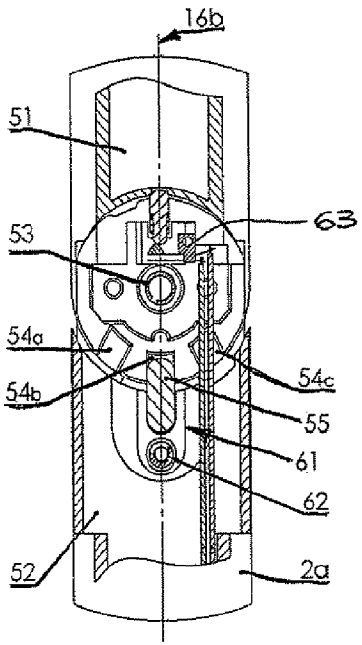
FIG.8
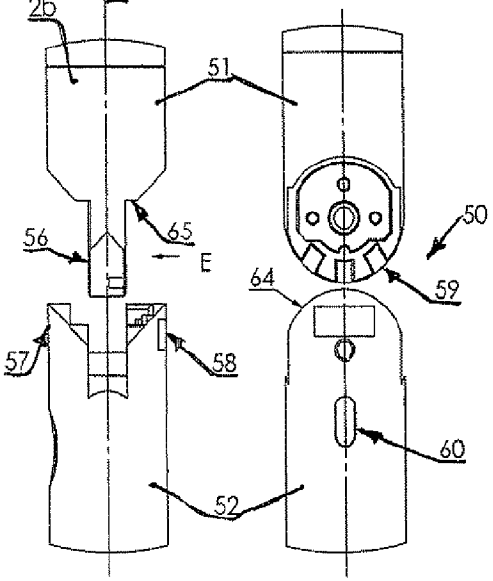
FIG.7
FIG.6

WINCH-ACTUATED UMBRELLA

BACKGROUND OF THE INVENTION

The present invention relates to umbrellas having a winch by which the umbrella is opened and closed and particularly, but not exclusively, to umbrellas having a motorised winch.

A typical large umbrella for use with outdoor seating, or the like, is constructed with a support rod carrying at its uppermost end a crown with radiating ribs pivotally connected thereto and a sleeve sliding over the rod with struts being interconnected between the sleeve and the ribs. Various drive mechanisms have been provided to slide the sleeve along the rod in order to cause the struts to splay the ribs attached to the crown upwardly and outwardly to erect the umbrella.

A winch may be employed to erect the umbrella, turning the winch tightens a line trained about a pulley at the upper end of the rod and connected to the sleeve. In tiltable umbrellas the rod includes upper and lower portions joined by a transverse pivot to allow relative angular movement. The winch likewise includes a drum mounted upon a transversely aligned axle. A sector engaging a rack or worm wheel may be provided for accurately positioning the upper portion relative to the lower portion. As a result of the above complexity these prior art designs have assumed an unattractive appearance owing to the presence of many exposed mechanical elements, and the size of these elements or their housings projecting from the support rod is a drawback, both for use and storage of these umbrellas. It is therefore an object of the present invention to overcome or substantially ameliorate at least one of the above disadvantages, or more generally to provide an improved umbrella.

DISCLOSURE OF THE INVENTION

In one aspect the present invention provides a motorised umbrella comprising a support tube;

a plurality of radially disposed ribs, each rib being pivotally connected at one end to an end of the tube;

a sleeve in external sliding relationship to the tube and moveable relative thereto between an outer extended position and a retracted position;

a plurality of struts pivotally connected between the sleeve and associated ones of the ribs, and drive means for moving the sleeve between the extended and retracted positions, whereby the struts cause the ribs to splay outwardly of rod in response to movement of the sleeve to the extended position and the struts cause the ribs to collapse inwardly in response to movement of the sleeve to the retracted position;

the drive means including:

- a winch drum mounted within the support tube to rotate about a longitudinal axis of the support tube;
- a threaded shaft coaxially mounted to the drum for rotation therewith;
- a line fixed at one end to the drum and at other end to the sleeve;
- a travelling nut engaged with the threaded shaft and blocked for rotation relative to the tube;
- a guide fixed to the nut for guiding the line onto the drum, and
- a motor enclosed in the support tube and drivingly connected to the winch drum.

Preferably the umbrella further includes:

driving and driven bevel gears mounted coaxially with the winch drum, the driven bevel gear being drivingly engaged with the drum;

a pinion connecting the driving and driven bevel gears, the pinion having means for engaging a crank handle;

a clutch connected between the motor and the driving gear for disconnecting drive from the motor to allow the crank handle to be used for manually rotating the winch drum.

The crank handle preferably comprises a socket for drivingly engaging a recess in the pinion.

Preferably the clutch includes an actuating member for engaging or disengaging the clutch, the actuating member protruding transversely through the support tube and having a portion which protrudes from the support tube at a position circumferentially aligned with the crank-receiving socket.

Preferably the umbrella further includes a joint assembly in the umbrella, joining an upper part of the support tube to a lower part of the support tube, the joint assembly comprising:

a transverse pivot connecting the upper and lower parts of the support tube;

a detent in one of the upper and lower parts for engaging one of plurality of angularly spaced features in the other of the upper and lower parts to fix the upper and lower parts in respective angular positions, and an interlock fixed to one of the upper and lower parts and actuated by engagement with the other of the upper and lower parts to prevent actuation of the motor when the upper part is inclined relative to the lower part

BRIEF DESCRIPTION OF THE DRAWINGS

Preferred forms of the present invention will now be described by way of example with reference to the accompanying drawings, wherein.

FIGS. 6 and 7 are front and side exploded views of joint members connecting the upper and lower support tubes of the umbrella of FIG. 1;

FIG. 8 is an enlarged view of the joint portion C of FIG. 1 wherein one of the two flanges comprising the joint is cut away for clarity;

FIG. 9 is a longitudinal cross section in the central plane of a pin for locking the joint for tilting movement of the umbrella, and FIG. 10 shows the section of FIG. 9 with the upper support tube in a tilted position.

DESCRIPTION OF THE PREFERRED EMBODIMENTS

Figure 1:
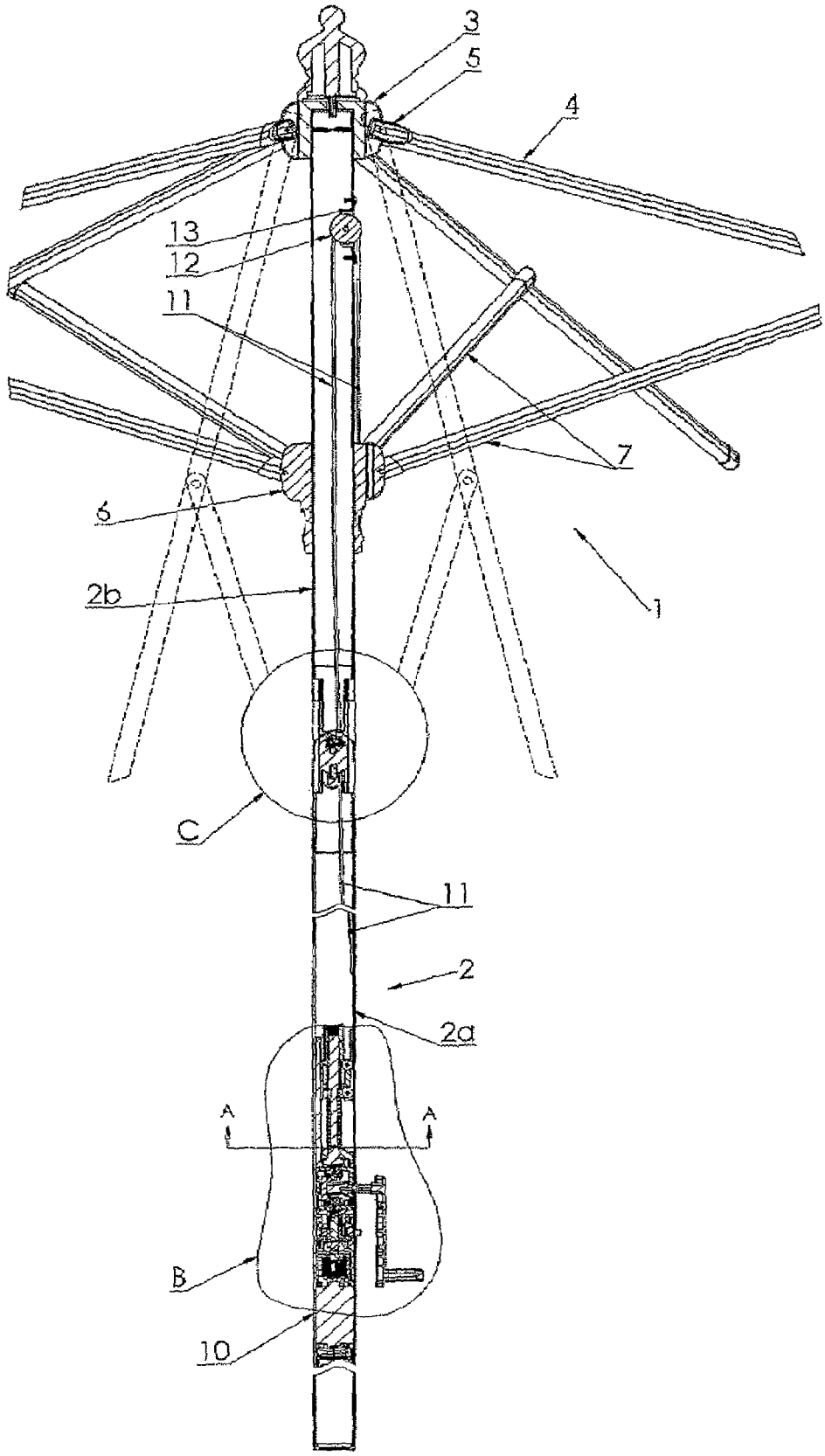
FIG. 1 is a central longitudinal section through a motorised umbrella according to the present invention.

Referring to FIG. 1, a motorised umbrella 1 includes an upright support tube assembly 2 having a crown 3 fixed at an outer end thereof. A plurality ribs 4 for supporting the umbrella canopy (not shown) are connected at one end to the crown 3 by pivots 5 to extend radially from the support tube assembly 2. A yoke 6 is in external sliding relationship to the support tube assembly 2 received therein. The yoke 6 is moveable relative to the support tube assembly 2 between the extended (upper) position shown and a retracted position.

Note that the terms "inner" and "outer" are used to describe relationships relative to both of the two longitudinally opposing ends of the central tube assembly of the umbrella. References in brackets relate to the upright orientation shown in the figures and are added for clarity.

A plurality of struts 7 are pivotally connected to the yoke 6, each strut 7 being connected to an associated one of the ribs 4. When moving the yoke 6 from the retracted position to the extended position, the struts 7 cause the ribs 4 to splay outwardly of support tube assembly 2. The struts 7 cause the ribs 4 to collapse inwardly in response to movement of the yoke 6 to the retracted position (shown in dashed outline).

The support tube assembly 2 includes lower support tube 2*a* which, for instance, may be received in an aperture in a table, or the like, and upper support tube 2*b* to which the crown 3 is mounted. A winch 10 mounted in the lower support tube 2*a* provides drive means for moving the sleeve between the extended and retracted positions. A line 11 engaged with the winch 10 extends longitudinally within lower support tube 2*a*, around a pulley 12 and through an aperture 13 in the upper support tube 2*b*, to connect to the yoke 6.

Figure 2:
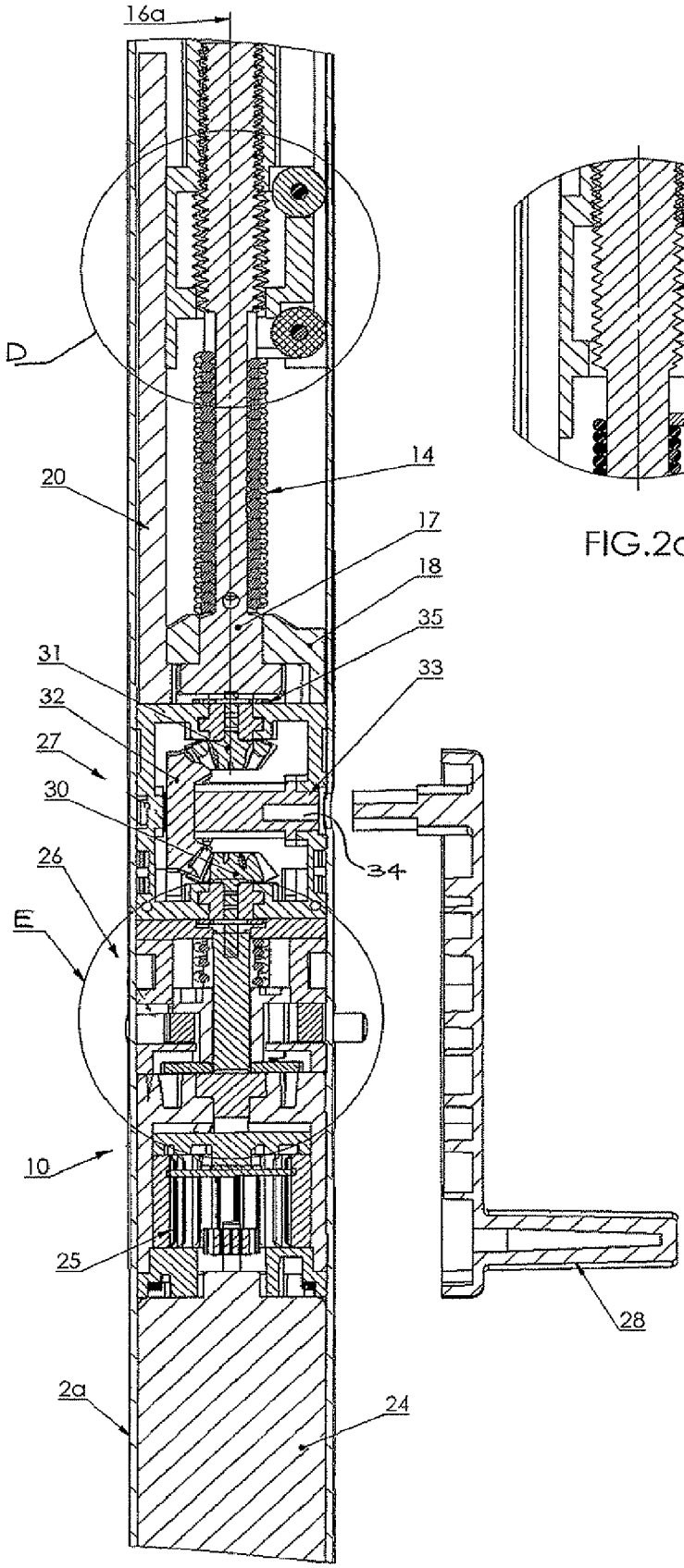
FIG. 2 is an enlarged view of the portion B of FIG. 1.
Figure 2A:
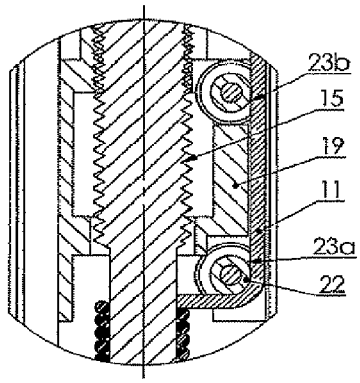
FIG. 2*a* is a fragmentary longitudinal section of portion D of FIG. 2 in a plane offset from the central longitudinal axis.
Figure 3:
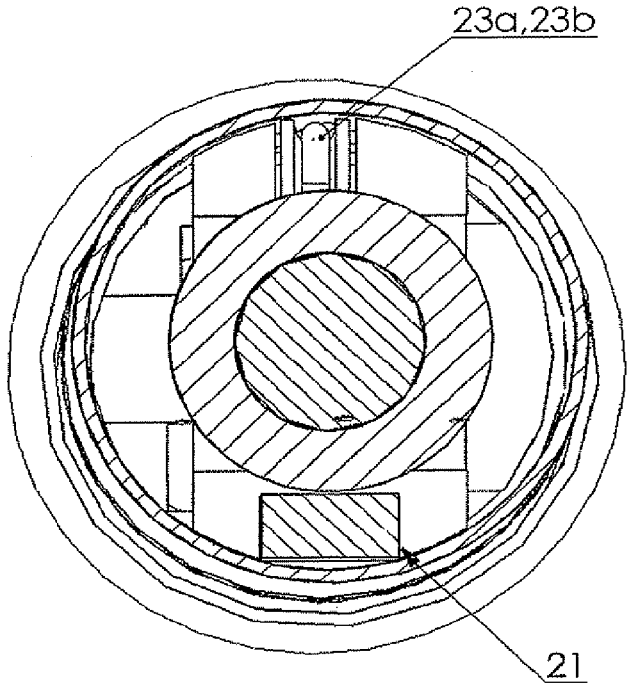
FIG. 3 is an enlarged view of the section AA of FIG. 1 with the clutch in an engaged position.

As seen in FIG. 2, a winch drum 14 and threaded shaft 15 are integrally formed from an elongate member mounted coaxially with the central longitudinal axis 16*a* of the lower tube 2*a*. A journal 17 engages a bearing block 18 fixed inside the tube 2*a*, to support the drum 14 and shaft 15 for rotation about axis 16*a*.

A nut 19 is engaged with the treaded shaft 15 and has a longitudinally aligned slot 21. A bar 20 fixed to the inner wall of the tube 2*a* extends axially and is received in the slot 21 to block rotation of the nut 19. The line 11 approaches the nut in the longitudinal direction, passes about a roller guide 22 fixed to the nut 19 and is fed generally transversely into the drum 14. One end of the line 11 is fixed to the drum 14, such that the line is wound in a helix of the same pitch as that of the screw threads. On the nut 19, opposite the slot 21, a pair of axially spaced wheels 23*a*, 23*b* engage the inner wall of the tube 2*a*.

The drum 14 and shaft 15 are rotated by a motor 24, driven through a primary gearbox 25, a clutch 26 and then a secondary gearbox 27. The primary gearbox 25 serves to reduce the speed and increase the torque supplied to the clutch 26. The primary gearbox 25 is mounted within the lower tube 2*a* coaxially with the adjacent motor 24. The clutch 26 and secondary gearbox 27 cooperate to allow the umbrella to be operated using either the motor 24 or a crank handle 28 to rotate the drum 14 and shaft 15.

The secondary gearbox 27 includes opposing driving and driven bevel gears 30, 31 mounted coaxially with the axis 16 and connected by a pinion 32. The pinion 32 is mounted on a transversely extending axle 33 which includes a socket 34 for receiving the crank handle 28. The driven bevel gear 31 is connected to the winch drum 14 and threaded shaft 15 by a coupling shaft 35 mounted for rotation in a bearing sleeve 36 fixed inside the support tube assembly.

Figure 4:
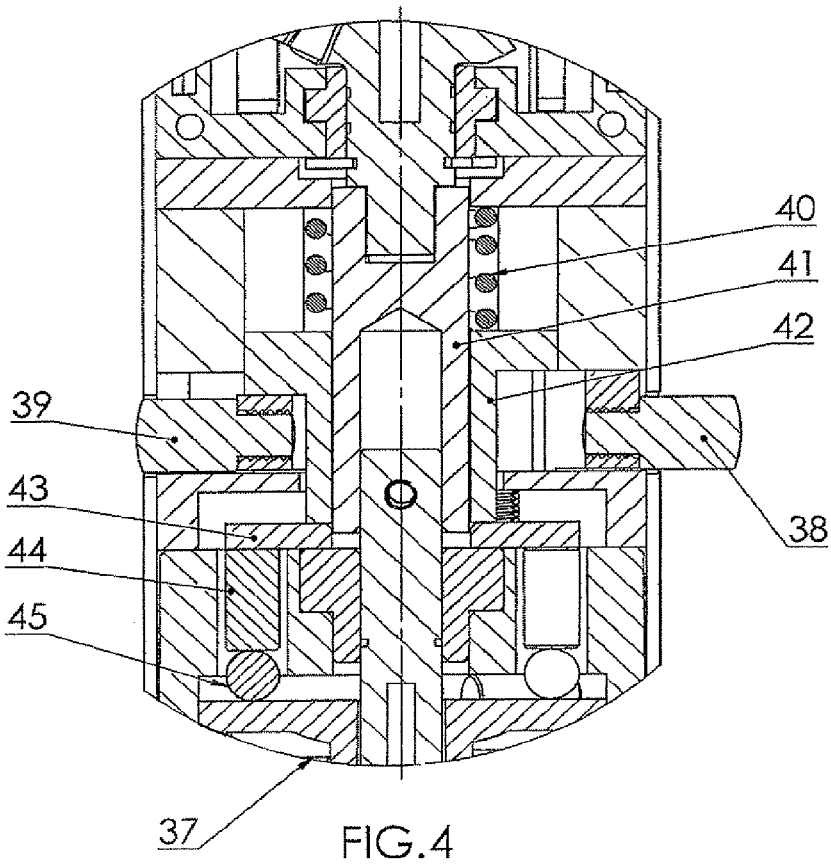
FIG. 4 is an enlargement of the clutch portion E of FIG. 2.

The clutch 26 is mounted between the output 37 from the primary gearbox 25 and the driving bevel gear 30. As best seen in FIG. 4, the clutch 26 includes an actuating member extending transversely through the lower tube 2*a* and having button portions 38, 39 on opposing ends thereof which protrude from either side of the support tube 2*a* and are pressed to release and engage the clutch 26 respectively. A spring 40 is mounted (around a hub 41 fixed to the driving bevel gear 30) to bear against an axially sliding collar 42, which through the abutting thrust plate 43 and pins 44 in turn holds balls 45 in recesses in a flange portion 39 of the rotating output 37. In this manner the torque is transmitted through the thrust plate 43 to the hub 41 and thus to the driving bevel gear 30.

Figure 5:
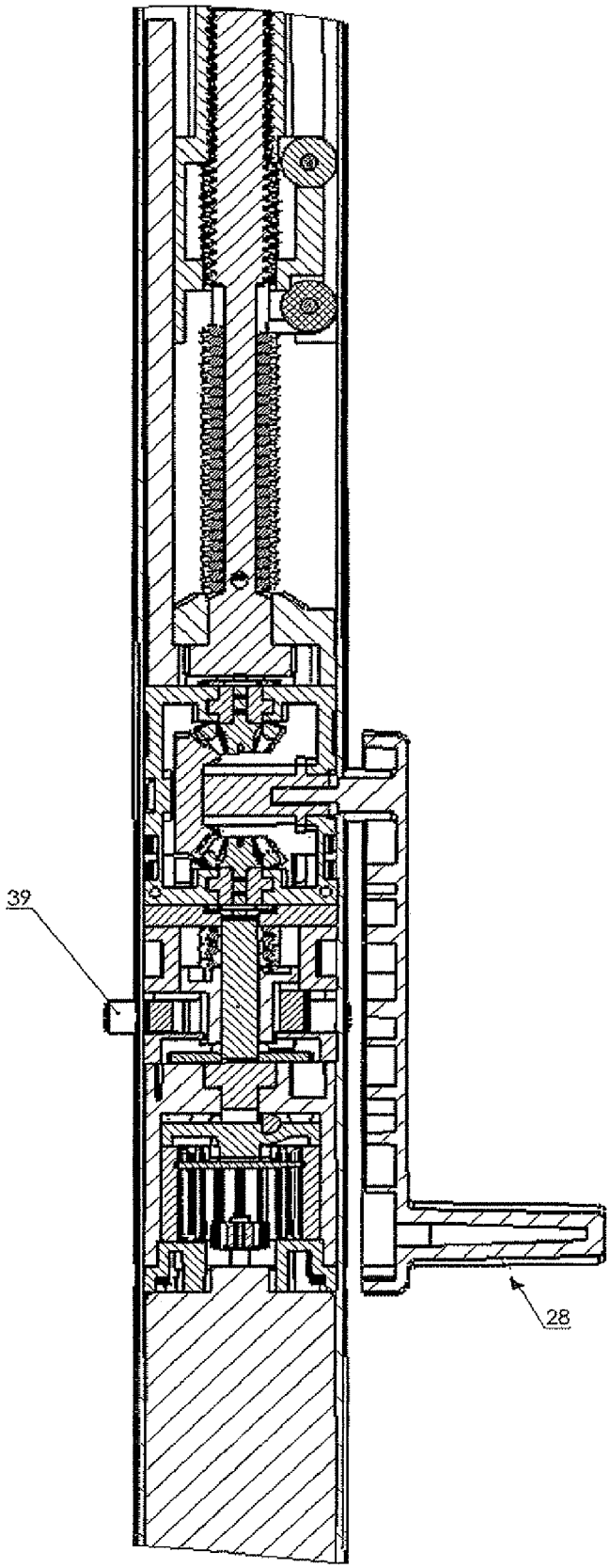
FIG. 5 is an enlarged view of the portion B of FIG. 1 with the clutch in a released position.

When the button portion 38 is pressed (FIG. 5) inclined faces (not shown) on the actuating member 30 and collar 42 cooperate to move the collar 42 axially so as to compress the spring 40, thereby allowing the balls 45 to ride up out of the recesses in the output 37, disengaging the drive from the primary gearbox 25. In the released position (FIGS. 2 and 4) the button portion 38 protrudes from the lower tube 2*a* at a position circumferentially aligned with the crank-receiving socket 34. In this manner the button portion 38 projects into the path traced in use by rotation of the crank handle 28 providing a visual clue to the user that, in order to crank the handle 28, it is necessary to press the button 38, not only to release the clutch but to allow the handle 28 to pass the button 38.

Stacked within the support tube 2*a*, below the motor 24 are five rechargeable batteries for powering the motor. A socket in the support tube assembly is provided for plugging in a power supply (not shown) for charging the batteries.

FIGS. 6-10 illustrate a joint assembly 50 between the upper and lower support tubes 2*a*, 2*b*, each of which are fixed to a respective upper an lower joint member 51, 52 joined by a transverse pivot 53. Protruding from an end of the upper joint member 51 is a central tongue 56 with a semicircular edge 59. The tongue 56 is received between flanges 57, 58 protruding from the end of the lower joint member 52, the pivot 53 extending between both flanges 57, 58. Three recesses 54*a*, 54*b*, 54*c* are provided in the edge of the flange 56, recesses 54*a* and 54*c* being equally angularly spaced either side of the central recess 54*b*. A detent 61 is mounted to slide longitudinally in the lower joint member 52 and includes a nub portion 55 and a button portion 60. The button portion 60 is exposed externally and for manual release of the detent, for instance, sliding the button longitudinally against the urging of spring 62 withdraw the nub 55 from one of the recesses 54, allowing the members to be inclined relative one another for tilting the umbrella.

The outer edge of the flange 58 has a convex face 64 complementary to an adjacent concave face 65 on the upper joint member 51. A pin 66 is received in a longitudinally aligned recess in the extending through the convex face 65. A beam spring 67 engages one end of the pin 66 to bias the opposing end outward toward the concave face 65. A recess 68 in the concave face 65 is longitudinally aligned with the axis 16. An interlock switch 63 is provided in the electrical circuit controlling the operation of the motor 24, the switch 63 being mounted adjacent the pin 66 in the lower joint member 52. An actuating lever 69 extends from the switch 63 below the beam spring 67.

In use, with the upper and lower portions of the support tube aligned, as shown in FIG. 9, the pin 66 is received in the recess 68 and the switch is in a first state, for instance, an electrically closed position. Any rotation of the portions of the support tube, as shown in FIG. 10, displaces the pin 66 from the recess 68, pushing the pin 66 against the actuating lever 69 to move the switch to a second state, for instance, an electrically open position. In this manner the switch 63 is used to prevent operation of the motor 24 when the upper and lower support tubes 2*a*, 2*b* are inclined.

Aspects of the present invention have been described by way of example only and it should be appreciated that modifications and additions may be made thereto without departing from the scope thereof.

The invention claimed is:

1. A motorised umbrella comprising:

a support tube;

a plurality of radially disposed ribs, each rib being pivotally connected at one end to an end of the support tube;

a sleeve in external sliding relationship to the tube and moveable relative to the support tube between an outer extended position and a retracted position;

a plurality of struts pivotally connected between the sleeve and associated ones of the ribs, and drive means for moving the sleeve between the extended and retracted positions, whereby the struts cause the ribs to splay outwardly of the support tube in response to movement of the sleeve to the extended position, wherein the struts cause the ribs to collapse inwardly in response to movement of the sleeve to the retracted position, the drive means including:

a winch drum mounted within the support tube to rotate about a longitudinal axis of the support tube, a threaded shaft coaxially mounted to the drum for rotation with the drum, a line fixed at a first end to the winch drum and at a second end to the sleeve, a travelling nut engaged with the threaded shaft and blocked for rotation relative to the support tube, a guide fixed to the nut for guiding the line onto the winch drum, and a motor enclosed in the support tube and drivingly connected to the winch drum.

2. The umbrella of claim 1 further including:

driving and driven bevel gears mounted coaxially with the winch drum, the driven bevel gear being drivingly engaged with the winch drum;

a pinion connecting the driving and driven bevel gears, the pinion having means for engaging a crank handle; and a clutch connected between the motor and the driving gear for disconnecting drive from the motor to allow the crank handle to be used for manually rotating the winch drum.

3. The umbrella of claim 1 wherein the crank handle comprises a socket for drivingly engaging a recess in the pinion.

4. The umbrella of claim 3 wherein the clutch includes an actuating member for engaging and disengaging the clutch, and the actuating member protrudes transversely through the support tube and has a portion which protrudes from the support tube at a position circumferentially aligned with the socket.

5. The umbrella of claim 1 wherein the umbrella further includes a joint assembly in the umbrella, joining an upper part of the support tube to a lower part of the support tube, the joint assembly comprising:

a transverse pivot connecting the upper and lower parts of the support tube;

a detent in one of the upper and lower parts for engaging one of a plurality of angularly spaced features in the other of the upper and lower parts to fix the upper and lower parts in respective angular positions, and an interlock fixed to one of the upper and lower parts and actuated by engagement with the other of the upper and lower parts to prevent actuation of the motor when the upper part is inclined relative to the lower part.

* * * * *